United States Patent [19]

Kumano et al.

[11] Patent Number: 4,488,472

[45] Date of Patent: Dec. 18, 1984

[54] KEYBOARD MUSICAL INSTRUMENT

[75] Inventors: Shinji Kumano; Masao Kondo, both of Hamamatsu, Japan

[73] Assignee: Nippon Gakki Seizo Kabushiki Kaisha, Shizuoka, Japan

[21] Appl. No.: 369,195

[22] Filed: Apr. 16, 1982

[30] Foreign Application Priority Data

May 1, 1981 [JP] Japan ..... 56-66747

[51] Int. Cl.[3] ..... G10C 3/12

[52] U.S. Cl. ..... 84/434; 84/435; 84/436

[58] Field of Search ..... 84/434, 435, 433, 436

[56] References Cited

U.S. PATENT DOCUMENTS 3,797,357 3/1974 Thomas et al. ..... 84/433 X 4,129,057 12/1978 Hoshi ..... 84/434

FOREIGN PATENT DOCUMENTS 692245 7/1965 Italy ..... 84/433

*Primary Examiner*—Michael L. Gellner

*Assistant Examiner*—Della J. Rutledge

*Attorney, Agent, or Firm*—Darby & Darby

[57] ABSTRACT

A keyboard musical instrument includes a plurality of keys mounted on a casing in juxtaposed relation. Each of the keys has a retaining portion engageable with a key stop portion on the casing to limit the upward movement of the key. A resilient leaf is formed integral with each key and extends rearwardly therefrom. The resilient leaf nomally urges each key into its raised position. The resilient leaf has an engaging section at its rear portion. The engaging section is detachably retained in a retaining groove formed on the casing. A guide surface is formed on the casing immediately adjacent to and forwardly of the retaining groove for facilitating the insertion of the engaging section into the retaining groove.

8 Claims, 8 Drawing Figures

FIG. 1 (A) (Prior Art)

FIG. 1 (B) (Prior Art)

KEYBOARD MUSICAL INSTRUMENT

BACKGROUND OF THE INVENTION

1. Field of the Invention

This invention relates generally to a keyboard musical instrument such as a portable electronic organ and particularly to a keyboard structure comprising a plurality of juxtaposed keys.

2. Prior Art

FIGS. 1(A) and 1(B) show typical examples of conventional keyboard structures under consideration which comprise a plurality of keys 100 mounted on a casing in a juxtaposed relation. Each key 100 has a resilient rear portion 100*a* which is fixedly secured by a fastening means 101 such as a screw to a key-mounting portion 102 of the casting to allow the key 100 to move between its raised and lowered positions. This fastening operation requires much time and labor because the keys must be attached one by one to the key-mounting portion 102 by means of the screws. In addition, much labor is required to remove a damaged key from the casing for replacement by a new one. Another disadvantage is that the number of the component parts are increased because of the use of the screws, which results in additional manufacturing costs.

SUMMARY OF THE INVENTION

It is therefore an object of this invention to provide a keyboard musical instrument of the type which permits easy and quick installation of keys without the need for separate fastening means such as screws.

According to the present invention, there is provided a keyboard musical instrument which comprises a casing having a retaining groove and a key stop portion; a plurality of juxtaposed keys mounted on the casing for movement between raised and lowered positions, each key having a retaining portion engageable with the key stop portion to limit the upward movement of the key; a resilient leaf formed integral with each key and extending rearwardly therefrom, the resilient leaf normally urging each key into its raised position, the resilient leaf having an engaging section at its rear portion, and the engaging section being detachably retained in the retaining groove; and guide means formed on the casing immediately adjacent to and forwardly of the retaining groove for facilitating the insertion of the engaging section into the retaining groove.

Other advantages, features and additional objects of the present invention will become manifest to those versed in the art upon making reference to the detailed description and the accompanying sheets of drawings in which preferred embodiments incorporating the principles of the present invention are shown by way of illustrative examples and in which like reference numeral denote corresponding parts in several views.

BRIEF DESCRIPTION OF THE DRAWINGS

FIG. 1(A) is a fragmentary cross-sectional view of a conventional keyboard structure, showing a key mounted on a casing;

FIG. 1(B) is a view similar to FIG. 1(A) but showing another prior art keyboard structure;

DESCRIPTION OF THE PREFERRED EMBODIMENTS OF THE INVENTION

Figure 2:
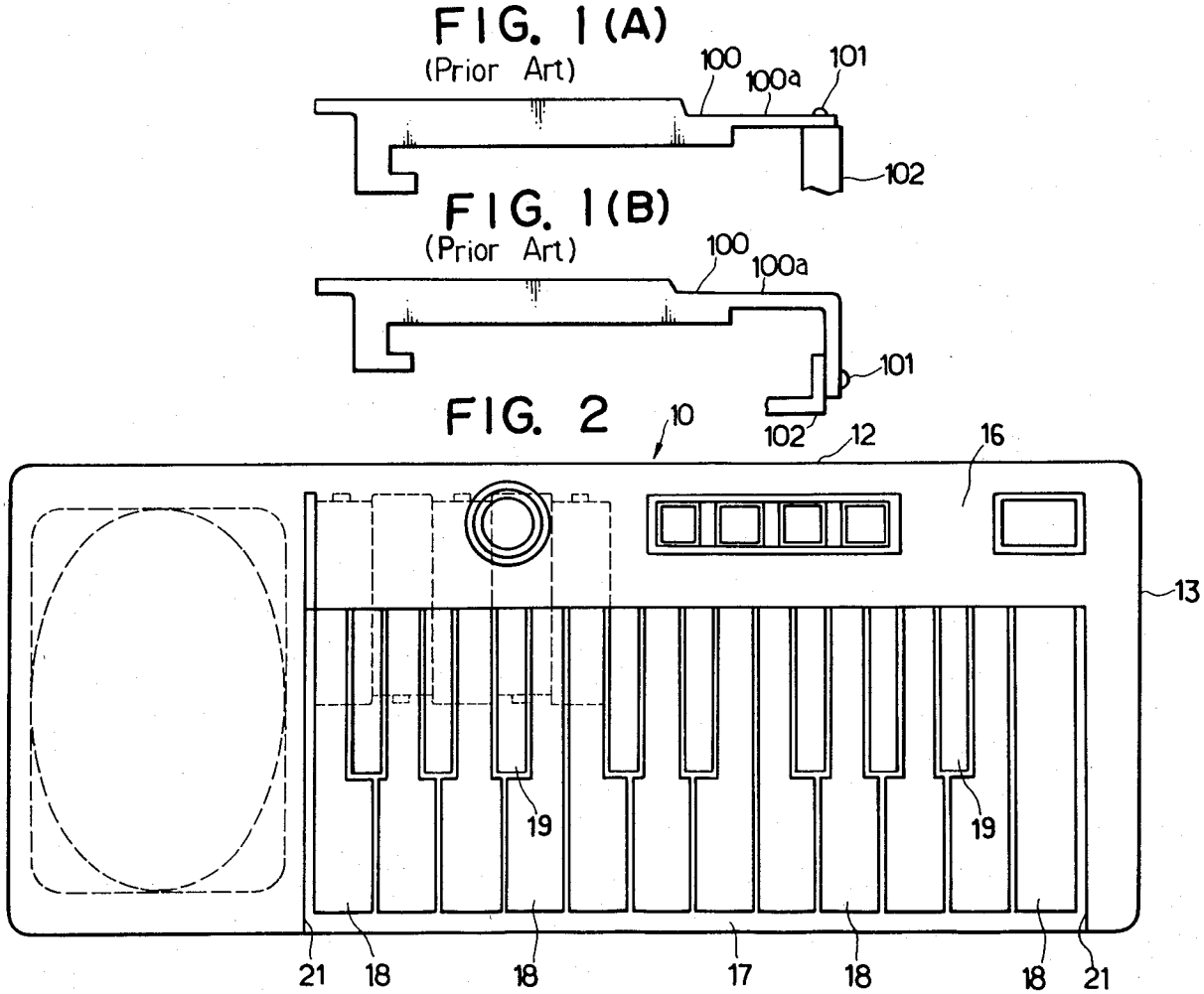
FIG. 2 is a plan view of a keyboard musical instrument or portable electronic organ constructed in accordance with the present invention.
Figure 3:
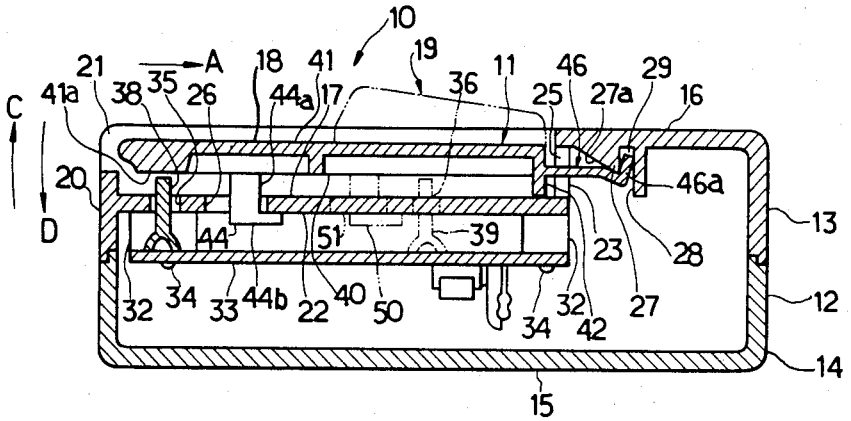
FIG. 3 is a cross-sectional view of the keyboard musical instrument.

FIGS. 2 and 3 show a portable electronic organ 10 having a keyboard structure 11. The organ 10 comprises a box-like casing 12 which comprises upper and lower halves or shells 13 and 14 coupled together. Each of the upper and lower shells 13 and 14 is of a single molded construction and made of plastics or other suitable synthetic resin. The lower shell 14 is in the form of a box having an open top and a rectangular bottom wall 15. The upper shell 13 of a rectangular configuration has a top wall 16 disposed in parallel relation to the bottom wall 15 of the lower shell 14. The upper and lower shells 13 and 14 are connected together by a suitable fastening means (not shown) with their peripheral edges mated together.

The upper shell 13 has a rectangular recess 17 for receiving a row of white and black keys 18 and 19 therein, as will hereinafter more fully be described, the recess 17 opening to a front wall 20 of the upper shell 13. The recess 17 is defined by a pair of parallel spaced side walls 21 and 21 (FIG. 2), a bottom wall 22 extending between the side walls 21 and 21 in parallel relation to the top wall 16, and a rear wall 23 extending between the side walls 21 and 21 and interconnecting the top wall 16 and the bottom wall 22, the rear wall 23 disposed perpendicular to the top wall 16 and the bottom wall 22.

A plurality of apertures 25 are formed through the rear wall 23 and spaced along the length thereof. A plurality of slots 26 are formed through the bottom wall 22 and spaced along the length of the front wall 20.

An elongated projection 27 of a wedge-shaped cross-section is formed integrally on the underside of the top wall 16 adjacent to the rear wall 23, the projection 27 extending along the rear wall 23. The projection 27 has a front surface 27*a* inclined relative to the top wall 16. Also, a web 28 is formed integrally on the underside of the top wall 16 adjacent to the projection 27 and extends therealong so that the closely spaced apart projection 27 and web 28 define a groove 29 of a generally downwardly opening channel shape therebetween, the parallel opposed walls of them being disposed perpendicular to the top wall 16. The web 28 extends downwardly beyond the projection 27.

Mounting portions 32 are formed integrally on the underside of the bottom wall 22 of the recess 17. A printed circuit board 33, on which electronic components are fabricated as shown in FIG. 3, is fixedly secured by screws 34 to the mounting portions 32 in parallel spaced relation to the bottom wall 22. A series of apertures 35 are formed through the bottom wall 22 adjacent to the front wall 20 and spaced along the length thereof. Similarly, a series of apertures 36 are formed through the bottom wall 22, the apertures 36 being disposed rearwardly of the slots 26.

A plurality of electrically conductive rubber elements 38 are mounted on the printed circuit board 33 and extend through the apertures 35, respectively. Similarly, a plurality of electrically conductive rubber elements 39 are mounted on the printed circuit board 33 and extend through the apertures 36, respectively.

As best shown in FIG. 3, each of the juxtaposed white keys 18 includes an elongated body of a generally channel-shaped cross-section defined by a pair of opposed arms 40 only one of which is shown in FIG. 3, an upper wall 41 interconnecting the arms 40 at their upper edges, and a rear wall 42 extending between the arms 40 and depending from the upper wall 41. The rear wall 42 extends downwardly beyond the arms 40. The white key body is of a one-piece molded construction and made of a suitable synthetic resin. The front end portion 41*a* of the upper wall 41 is formed into a thickened cross-section to provide a key switch actuator portion. The actuator portion 41*a* of each white key 18 is disposed in registry with a respective one of the electrically conductive rubber elements 38.

The key body has a retaining portion 44 of an L-shape formed integrally on the lower edge of one of the arms 40. The L-shaped retaining portion 44 has a first leg 44*a* depending from the arm 40 and a second leg 44*b* extending perpendicularly from the first leg 40*a* at its lower end and directed toward the rear wall 42.

The white key 18 has a resilient portion or leaf 46 formed integral with and extending rearwardly from the rear wall 42 in parallel relation to the upper wall 41, the resilient leaf 46 being disposed generally centrally of the height of the rear wall 42, as shown in FIG. 3. The resilient leaf 46 has its rear end portion directed upwardly to provide an engaging section 46*a*, so that it has a cross-section of a recumbent L-shape. The resilient leaf 46 is made of such a synthetic resin that it performs the same function of a leaf spring.

As shown in FIG. 3, each white key 18 is received in the recess 17 of the upper shell 13 with the resilient leaf 46 extending through the aperture 25 and with the engaging section 46*a* fitted in the groove 28. In this condition, the resilient leaf 46 is slightly resiliently deformed to apply a preload to the white key 18 for urging it to its raised or inoperative position (FIG. 3). The first leg 44*a* of the L-shaped retaining portion 44 extends through the slot 26, and the second leg 44*b* is held in engagement with the underside of the bottom wall 22 adjacent to the slot 26 to limit the upward movement of the white key 18. Thus, this portion serves as a key stop portion. The lower end of the rear wall 42 of the white key 18 is held against the bottom wall 22 of the recess 17. The lower end of the rear wall 42 serves as fulcrum means for the pivotable white key 18.

For installing each white key 18 on the upper shell 13 of the casing 12, the white key 18 is first placed in position in the recess 17 of the upper shell 13 with the L-shaped retaining portion 44 received in the slot 26 and with the lower end of the rear wall 42 held in engagement with the bottom wall 22 of the recess 17. Then, the white key 18 is moved in a direction rearward indicated by an arrow A (FIG. 3) so that the upper end of the engaging section 46*a* of the resilient leaf 46 is slidingly moved along the inclined surface 27*a* of the wedge-shaped projection 27. In this condition, the resilient leaf 46 is resiliently deformed or flexed downwardly. Finally, the engaging section 46*a* slides over the inclined surface 27*a* and is snappingly introduced into the groove 29 under the restoring action of the flexed resilient leaf 46. As described above, in this condition, the resilient leaf 46 is slightly deformed downwardly to urge the white key 18 to pivotally move about the lower end of the rear wall 42 in a direction C (FIG. 3) so that the second leg 44*b* of the retaining portion 44 is held in abutting engagement with the above-mentioned key stop portion to thereby limit the upward movement of the white key 18. Thus, the white key 18 can be quite easily attached to the upper shell 13 merely by pushing the engaging section 46*a* of the resilient leaf 46 into the groove 29. The wedge-shaped projection 27 with the inclined surface 27*a* serves as guide means for guiding the movement of the engaging section 46*a* when it is introduced into the groove 29.

Each of the black keys 19, which is substantially shorter than the white key 18, includes an elongated body of a channel-shaped cross-section. As described above for the white key 18, the black key 19 has an L-shaped retaining portion 50 and a key switch actuator portion (not shown) disposed in registry with the electrically conductive rubber element 36. The black key 19 has an integral resilient leaf (not shown) extending rearwardly from the key body, this resilient leaf being similar in construction to the resilient leaf 46 of the white key 18. The L-shaped retaining portion 50 is received in a slot 51 through the bottom wall 22 of the recess 17 to limit the upward movement of the black key, as described above for the white key 18. By virtue of the provision of the resilient leaf, the black key 19 is attached to the upper shell 13 and functions in the manner described above for the white key 18.

Upon depression of each white key 18 against the bias of the resilient leaf 46, the white key is pivotally moved in a direction D (FIG. 3) about the lower end of the rear wall 42, and the actuator portion 41*a* urges the conductive rubber element 38 into contact with a switch contact on the printed circuit board 33 so that associated tone generating circuit and other circuits contained in the casing 12 are energized to electronically sound a selected note in a well known manner through an associated loud speaker. The actuator portion 41*a* is brought into engagement with the bottom wall 22 of the recess 17 to limit the downward movement of the white key 18. Upon release of the depressed white key 18, it is pivotally moved in a direction C (FIG. 3) into its raised or inoperative position under the influence of the flexed resilient leaf 46. Since the rear wall or fulcrum means 42 of the white key 18 is held against the bottom wall 22 of the recess 17, the engaging section 46*a* of the resilient leaf 46 is positively prevented from becoming disengaged from the groove 29 even when a push is applied to the rear portion of the key 18.

Each black key 19 operates in the manner described above for the white key 18.

Figure 4:
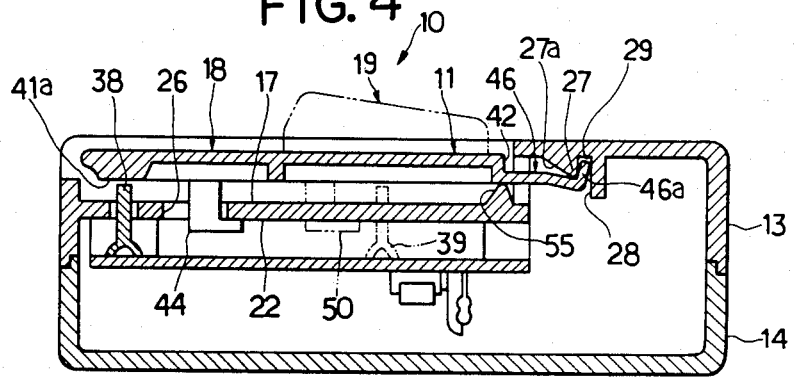
FIG. 4 to 6 are views similar to FIG. 3 but showing modified keyboard structures, respectively.

FIG. 4 shows a modified form of the invention. A keyboard structure 11 of this embodiment differs from the keyboard structure 11 of FIGS. 2 and 3 only in that the lower end of the rear wall 42 of the white key 18 lies flush with the lower surface of the resilient leaf 46 and in that an elongated ridge 55 of a triangular cross-section is formed integrally on the upper rear marginal portion of the recess bottom wall 22. The ridge 55 is held against the resilient leaf 46 at its upper end and serves as fulcrum means for the pivotable white key 18. Each black key 19 has the same modified structure.

Figure 5:
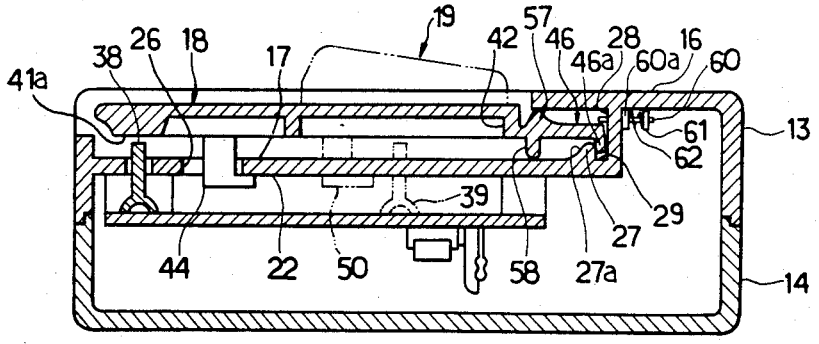

According to another modified form of the invention shown in FIG. 5, the top wall 16 of the upper shell 13 and the bottom wall 22 of the recess 17 are interconnected by a web 28. An elongated projection 27 of a wedge-shaped cross-section is formed integrally on the upper surface of the bottom wall 22 and extends along the web 28 in closely spaced relation thereto to provide a generally upwardly-opening channel shaped groove 29 therebetween. The wedge-shaped projection 27 has a front inclined surface 27*a*. The lower end of the rear wall 42 of the white key 18 lies flush with the lower surface of the resilient leaf 46. A ridge 57 of a triangular cross-section is integrally formed on the upper surface of the resilient leaf 46 adjacent to the rear wall 42 while a tongue 58 is integrally formed on the lower surface of the resilient leaf 46 adjacent to the rear wall 42, the lower end of the tongue 58 being rounded. The resilient leaf 46 has its rear portion directed downwardly to provide an engaging section 46*a*.

For installing the white key 18 on the upper shell 13, the white key is pushed rearwardly so that the engaging section 46*a* slides along the inclined surface 27*a* of the wedge-shaped projection or guide means 27 and is snappingly introduced into the groove 29. In this condition, the ridge 57 and the tongue 58 are held against the lower surface of the top wall 16 and the upper surface of the bottom wall 22, respectively, to serve as fulcrum means for the white key 18.

A retractable retaining pin 60 having a fixed collar 60*a* slidably extends through the web 28 at its front portion while the rear portion thereof is slidably supported by a support member 61 fixedly secured to the underside of the top wall 16. A compression coil spring 62 is wound around the retaining pin 60 and acts between the collar 60*a* and the support member 61. When the white key 18 is mounted in the recess 17, the spring-loaded pin 60 is retracted upon contact with the engaging section 46*a* of the resilient leaf 46 so that it is introduced into the groove 29 whereupon the spring-biased pin 60 is returned to its extended position (FIG. 5) to engage the upper surface of the resilient leaf 46. Thus, the engaging section 46*a* is positively retained in the groove 29.

Upon depression of the white key 18 against the bias of the resilient leaf 46, the ridge 57 slightly slides along the underside of the top wall 16 in a left-hand direction (FIG. 5) while the tongue 58 slightly slides along the upper surface of the bottom wall 22 in a right-hand direction. Each black key 19 has the same modified structure.

Figure 6:
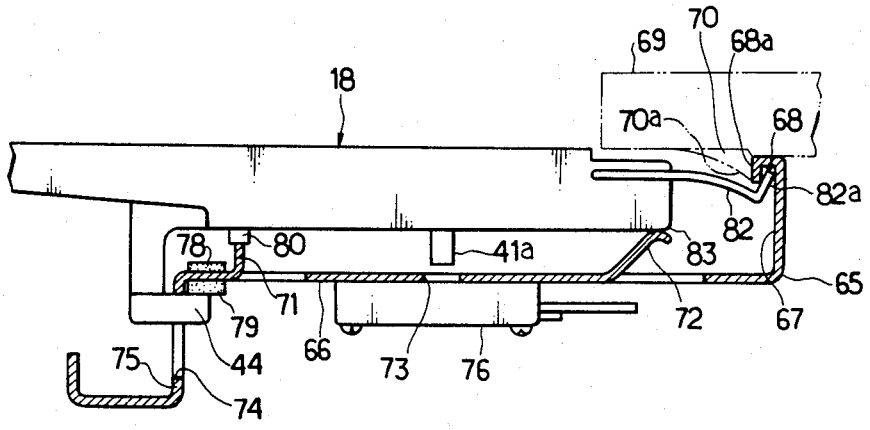

FIG. 6 shows a further modified form of the invention. In this embodiment, the white and black keys 18 and 19 are mounted on a frame or chassis 65 made of a metal plate. The frame 65 has a rectangular base 66 and a key-mounting portion 67 extending upwardly from the base 66 at its rear edge. The key-mounting portion 67 has a downwardly opening channel portion or groove 68 formed at its upper end. A top board member 69 of a generally rectangular cross-section is mounted on the channel portion 68, the board member 69 having a protuberance or guide means 70 formed integrally on the lower surface thereof. The lower surface 70*a* of the protuberance 70 is downwardly inclined relative to the base 66 of the frame 65, the lower end of the protuberance 70 lying flush with the lower end of the front wall 68*a* of the channel portion 68.

The frame 65 has a plurality of stamped-out webs 71, a stamped-out support portion 72 formed on and inclined relative to the base 66, and a plurality of apertures 73 formed through the base 66. A plurality of openings 74 are formed through the front wall 75 of the frame 65. A key switch assembly 76 is secured to the underside of the frame base 66, the key switch assembly containing an electrically conductive rubber strip and switch contacts. A pair of felt strips 78 and 79 are affixed to the opposite surfaces of the frame base 66 adjacent to the web 71. The upper portion of the web 71 is covered with a felt member 80.

The white key 18 includes a channel-shaped body having an L-shaped retaining portion 44 depending therefrom and a key switch actuator portion 41*a* extending downwardly therefrom. The white key 18 comprises a resilient leaf 82 made, for example, of a spring metal, the rear end portion of the resilient leaf 82 being directed upwardly to provide an engaging section 82*a*. The white key 18 is molded to the front portion of the resilient leaf 82.

For installing the white key 18 on the frame 65, it is arranged in position on the base 66 and then moved rearwardly with the engaging section 82*a* sliding along the inclined surface 70*a*. At this time, the lower edge 83 of the rear end of the key body slides along the inclined support portion 72. Finally, the engaging section 82*a* is snappingly introduced into the channel portion 68 and the rear end of the key body rides on the support portion 72. In this condition, the L-shaped retaining portion 44 of the white key 18 is received in the opening 74 and held against the felt strip 79 under the influence of the flexed resilient leaf 82. Upon depression of the white key 18, the actuator portion 41*a* is introduced into the aperture 73 to activate the key switch. The support portion 72 serves as the fulcrum for the white key 18. Each black key 19 has the same modified structure.

Figure 7:
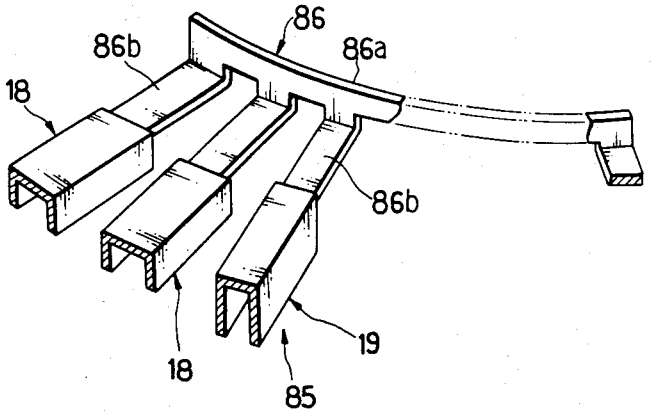
FIG. 7 is a perspective view of a multi-key structure in its preformed configuration.

The white and black keys 18 and 19 for the keyboard structure of FIG. 6 may be replaced by an integrally molded multi-key structure 85 shown in FIG. 7. The multi-key structure 85 comprises a resilient member 86 and a plurality of juxtaposed white and black key portions 18 and 19 molded thereto.

The integral resilient member 86 of a spring metal has a linear base 86*a* and a plurality of arms or leaves 86*b* extending perpendicularly from the base 86*a* at its lower edge and spaced along the length thereof. The base 86*a* performs the function of the engaging section 82*a* of the resilient leaf 82 (FIG. 6) and therefore is adapted to be received in the channel portion 68. The multi-key structure 85 is formed by injection molding. In the manufacture of the multi-key structure 85, the resilient member 86 is first placed as an insert in a mold with the base 86*a* being resiliently deformed into an arcuate configuration as shown in FIG. 7. In this condition, each adjacent arms 86*a* diverge toward their outer ends. Then, a molding material of a synthetic resin is injected into a cavity of the mold to form the multi-key structure 85. The key portions 18 and 19 are molded to the outer ends of the arms 86*b*, respectively, and each adjacent key portions so formed diverge toward their outer ends. Then, the multi-key structure 85 is taken out of the mold. The multi-key structure is still retained in an arcuate configuration as shown in FIG. 7 because of the presence of the runner. Finally, this runner is removed from the multi-key structure 85 in its preformed configuration so that the flexed base 86*a* is straightened under its own restoring action so that the arms 86*b* and hence the key portions 18 and 19 are brought into parallel relation. The multi-key structure 85 is mounted on the frame 65 (FIG. 6) in the manner described above for the white key 18 of FIG. 6.

Since each adjacent cavity sections for forming the key portions are disposed in diverging relation, the wall section of the mold therebetween has a relatively increased thickness. Therefore, the wall sections are prevented from fracture damage due to the pressure of the molding material applied to the cavity of the mold during the injecting molding operation. In addition, the mold of such a design can be easily manufactured.

As described above, by virtue of the provision of the resilient leaf, the groove for receiving the engaging section, and the guide means, each key can be detachably attached to the casing with utmost ease. Also, the provision of the fulcrum means ensures that the key is positively prevented from becoming displaced out of position even when a push is applied to the rear portion of the key.

What is claimed is:

1. A keyboard musical instrument which comprises:
(a) a casing having a retaining groove and a key stop portion;
(b) a plurality of juxtaposed keys mounted on said casing for movement between raised and lowered positions, each key having a retaining portion engageable with said key stop portion to limit the upward movement of said key;
(c) a resilient leaf formed integral with each key and extending rearwardly therefrom, said resilient leaf normally urging each key into its raised position, said resilient leaf having an engaging section at its rear portion, and said engaging section being detachably retained in said retaining groove; and
(d) guide means formed on said casing immediately adjacent to and forward of said retaining groove, said engaging section being insertable into said retaining groove by first being engaged with said guide means and moved rearwardly along said guide means to the end thereof.

2. A keyboard musical instrument according to claim 1, in which said guide means comprises a wedge-shaped projection having an inclined surface for guiding the movement of said engaging section when the latter is introduced into retaining groove.

3. A keyboard musical instrument according to claim 1, in which a fulcrum portion is formed integral with one of said key and said casing about which fulcrum portion said key is pivotally movable between its raised and lowered positions.

4. A keyboard musical instrument which comprises:
(a) a casing having a retaining groove and a key stop portion;
(b) a plurality of juxtaposed keys mounted on said casing for movement between raised and lowered positions, each key having a retaining portion engageable with said key stop portion to limit the upward movement of said key;
(c) a resilient leaf formed integral with each key and extending rearwardly therefrom, said resilient leaf normally urging each key into its raised position, said resilient leaf having an engaging section at its rear portion, and said engaging section being detachably retained in said retaining groove; and
(d) guide means formed on said casing immediately adjacent to and forward of said retaining groove for facilitating the insertion of said engaging section into said retaining groove;
said retaining groove having an upwardly-opening channel-shaped cross-section, said engaging section being directly downwardly.

5. A keyboard musical instrument according to claim 1, in which said retaining groove has a downwardly-opening channel-shaped cross-section, said engaging section being directed upwardly.

6. A keyboard musical instrument according to claim 1, in which said key and said resilient leaf are of a one-piece molded construction.

7. A keyboard musical instrument according to claim 1, in which said resilient leaf is made of a metal string.

8. A keyboard musical instrument according to claim 7, in which said engaging sections of said resilient leaves are connected together to form a continuous linear base, said linear base being resiliently deformable along the length thereof.

* * * * *